US007153216B1

(12) United States Patent
Pressley

(10) Patent No.: US 7,153,216 B1
(45) Date of Patent: Dec. 26, 2006

(54) PUTTER ALIGNMENT TRAINING SYSTEM

(76) Inventor: Norm Pressley, 7617 Pepita Way, La Jolla, CA (US) 92037

( * ) Notice: Subject to any disclaimer, the term of this patent is extended or adjusted under 35 U.S.C. 154(b) by 309 days.

(21) Appl. No.: 10/634,363

(22) Filed: Aug. 4, 2003

(51) Int. Cl.
*A63B 69/36* (2006.01)

(52) U.S. Cl. ..... 473/220; 473/223

(58) Field of Classification Search ..... 473/220, 473/221, 222, 223, 224, 225, 226, 257, 266, 473/267, 268, 278
See application file for complete search history.

(56) References Cited

U.S. PATENT DOCUMENTS

| | | | | | |
|---|---|---|---|---|---|
| 2,992,005 | A | * | 7/1961 | Lockhart | 473/257 |
| 3,802,709 | A | * | 4/1974 | Elkins, Jr. | 473/222 |
| 3,844,558 | A | * | 10/1974 | Gigliotti | 273/317.2 |
| 3,953,034 | A | | 4/1976 | Nelson | |
| 4,805,912 | A | * | 2/1989 | Hickman | 473/159 |
| 5,029,868 | A | * | 7/1991 | Cloud | 473/220 |
| 5,207,429 | A | | 5/1993 | Walmsley et al. | |
| 5,213,331 | A | * | 5/1993 | Avanzini | 473/220 |
| 5,217,228 | A | | 6/1993 | De Aguilar | |
| 5,388,831 | A | * | 2/1995 | Quadri et al. | 473/220 |
| 5,435,562 | A | | 7/1995 | Stock et al. | |
| 5,464,222 | A | | 11/1995 | Carney | |
| 5,465,972 | A | | 11/1995 | Cornett | |
| 5,494,290 | A | | 2/1996 | Stefanoski | |
| 5,501,452 | A | * | 3/1996 | Halvorson | 473/260 |
| 5,725,440 | A | | 3/1998 | Finney | |
| 5,882,266 | A | | 3/1999 | Schaum | |
| 5,964,668 | A | * | 10/1999 | Tai et al. | 473/220 |
| 6,095,930 | A | | 8/2000 | Siddall | |
| 6,123,626 | A | | 9/2000 | Osborn | |
| 6,450,893 | B1 | * | 9/2002 | Primiano et al. | 473/220 |
| 6,488,592 | B1 | * | 12/2002 | Boatner | 473/220 |
| 6,605,005 | B1 | * | 8/2003 | Lin | 473/220 |

* cited by examiner

*Primary Examiner*—Gregory Vidovich
*Assistant Examiner*—Nini F. Legesse
(74) *Attorney, Agent, or Firm*—Thomas J. Tighe, Esq.

(57) ABSTRACT

A laser assembly is removably attached to the shaft of a putter slightly above the head. The position and orientation of the laser assembly is adjusted to direct the laser horizontally in a plane passing through the sweet spot of the putter's face and perpendicular to the face when a user is addressing a golf ball with the putter. Once adjusted, the laser then can give accurate indications, against a backdrop, of the alignment of the putter with respect to a selected target hole, because the laser will illuminate a spot on the backdrop which is in accurate alignment with the putter, and thus allowing the golfer to compare his or her alignment prior to activating the laser. The laser is preferably momentarily actuated by a finger button attached to the putter at or near the grip.

19 Claims, 8 Drawing Sheets

PUTTER ALIGNMENT TRAINING SYSTEM

BACKGROUND OF THE INVENTION

This invention relates in general to the field of golf and to putting, but more particularly to an apparatus using a laser beam generator for accurately aligning a putter and for indicating the putter's alignment.

The saying, "Driving for show and putting for dough" is still as valid a description of the importance of putting in the game and sport of golf as when it was first coined. Hereafter, golf will be referred to only as a game although it is also an extremely popular sport. The overriding tenet of golf is to hit the golf ball into the cup in as few strokes as possible. And, particularly with golfers of comparable skill, the most accurate putter is the one who is most likely to end up with the lowest score. For this reason the putting part of the game of golf is extremely important and the reason golfers spend so much time practicing their putting, always trying to improve their putting accuracy.

There are a multitude of putters that have been developed and methods of improving a golfer's putting stroke in an effort to improve accuracy. However, even with experienced golfers, it is surprising how far off the target a golfer may line up his putter, thinking he has accurately lined up his putter to knock the ball into the hole. So, a device that can indicate to the golfer when his putter is accurately aligned with his target has indeed been needed.

The putter alignment apparatus of this invention will provide a golfer with information on which he can rely to know with confidence that he has accurately lined up his putter to putt a golf ball to its intended target. As such it is a valuable teaching aid, allowing the golfer to compare his best unaided alignment with truly accurate alignment feedback provided by this invention. The invention makes use of a laser beam generator, hereafter referred to as a "laser" which can generate a narrow beam of coherent light which will maintain its small diameter without noticeably diverging over the useful range of the device. This gives the golfer the opportunity to see instantly how the putter is aligned, and if misaligned, to what degree, and how to adjust the putter for correct alignment with the target. Through its use in practice, the golfer learns the appearance and feel for a more accurate putter alignment. The putter alignment apparatus will work on all types of putters and for either right or left-handed golfers. While the putter alignment apparatus is not allowed for official play, it serves as an excellent training and teaching aid to hone the golfer's putting accuracy.

Other advantages and attributes of this invention will be readily discernable upon a reading of the text hereinafter.

SUMMARY OF THE INVENTION

An object of this invention is to provide a putter alignment apparatus for use in training a golfer to become a more accurate putter.

An additional object of this invention is to provide a putter alignment apparatus which can easily be attached to a putter and which thereafter will provide true indications of actual putter alignment.

An additional object of this invention is to provide a putter alignment apparatus having a laser beam output which can be adjustably positioned to align at ninety degrees to the face of the putter, allowing the laser beam to indicate the true actual alignment of the putter.

An additional object of this invention is to provide a putter alignment apparatus for use both indoors and outdoors.

An additional object of this invention is to provide a putter alignment apparatus having a laser positioning device adjustably securable to the shaft of the putter by a clamp.

An additional object of this invention is to provide a putter alignment apparatus having a laser support for containing a laser and batteries.

An additional object of this invention is to provide a putter alignment apparatus having a laser support which can be positioned to allow a laser beam to be directed in a plane normal to the face of the putter.

An additional object of this invention is to provide a putter alignment apparatus having a laser turret in the end of the laser support which encloses a laser.

An additional object of this invention is to provide a putter alignment apparatus having a laser turret which allows the laser to rotate in a range of approximately 180°.

An additional object of this invention is to provide a putter alignment apparatus having a laser turret which can be maintained in a selected position.

An additional object of this invention is to provide a putter alignment apparatus having a clamp for clamping the laser support to the shaft of a putter.

An additional object of this invention is to provide a putter alignment apparatus having friction tape to affix to the shaft of the putter to provide a non-slip surface for the clamp to be removably affixed to the shaft.

An additional object of this invention is to provide a putter alignment apparatus having a clamp which allows the laser support to both freely rotate about the clamp's axis and also to freely pivot within a cone of approximately 60° before the clamp is tightened on the putter's shaft.

An additional object of this invention is to provide a putter alignment apparatus having a clamp which secures the laser support in its selected position once the clamp is tightened on the putter's shaft.

An additional object of this invention is to provide a putter alignment apparatus having a clamp with a tension cap which can be tightened to secure the clamp to the putter shaft and also secure the laser support in its selected position.

An additional object of this invention is to provide a putter alignment apparatus having a switch for activating the laser.

An additional object of this invention is to provide a putter alignment apparatus having a laser activating switch which can removably be affixed to the grip of a putter proximate a golfer's thumb for convenient operation of the laser.

An additional object of this invention is to provide a putter alignment apparatus having an alignment guide for use in aligning the laser normal to the face of the putter.

An additional object of this invention is to provide a putter alignment apparatus having an alignment guide with a straight line along the guide's centerline for use in aligning the laser.

An additional object of this invention is to provide a putter alignment apparatus having an alignment guide with an alignment stop affixed at one end of the guide against which the face of the putter is placed to align the face of the putter with the guide's centerline stripe.

An additional object of this invention is to provide a putter alignment apparatus having an alignment cradle formed by an upright leg joined to a second leg of an angle, the second leg affixed to the alignment guide.

An additional object of this invention is to provide a putter alignment apparatus having an alignment cradle with the angle between the legs of the stop set at generally 86° to conform to the standard 4° loft angle of a putter when the putter's face is placed against the surface of the cradle's upright leg.

An additional object of this invention is to provide a putter alignment apparatus having an alignment guide for placing behind a target when outdoors, allowing the spot illuminated by the laser beam to be visible on the guide.

An additional object of this invention is to provide a putter alignment apparatus having an alignment guide with a plurality of visible stripes uniformly spaced and oriented normal to the centerline stripe.

A further object of this invention is to provide a putter alignment apparatus having a ground stake for holding the alignment guide in position.

These objects, and other objects expressed or implied in this document, are accomplished by a putter alignment training system including: a turret including a laser emitting aperture; a remote switch for actuating the laser; a body having an axis, the turret being axially rotatably affixed to the body; a lockable articulated support arm projecting radially from the body; and a clamp for attaching the arm to a putter shaft; and the articulated arm being adjustable to so dispose the turret aperture that it can be rotatably adjusted to direct the laser horizontally in a plane passing through the sweet spot and perpendicular to the face of the putter when a user is addressing a golf ball with the putter. Preferably the articulation of the arm is a ball joint rotatable within a conal volume of space. Preferably the combination clamp and ball joint includes: a ball enveloped by a ball socket sufficiently to confine the ball to the socket, the ball having a radial threaded stem projecting from a mouth of the socket; a cylindrical barrel with a spherical cup at one end having an axially centered hole through which projects the threaded stem; one end of a rod is disposed in the barrel and freely travels back and forth therein, said one end defines an axial hole, the other end of the rod is threaded externally and defines an open slot to accommodate a putter's shaft, the threaded stems being screwed into the axial hole; two cylindrical spacers, each defining opposing circular notches, freely slide over the slotted end of the rod for clamping a putter's shaft therebetween; and a threaded knob engaged with the slotted end of the rod, the tightening of the knob over the threaded end of the rod acting against the two spacers and the barrel and also causing tension through the rod to the ball stem, the spacers in reaction to the force of the knob clamping the putter shaft, and the barrel in reaction to the force of the knob transmitted through the spacers applying compression force to the mouth of the ball socket via the barrel's spherical cup.

DESCRIPTION OF THE PREFERRED EMBODIMENT

Figure 1:
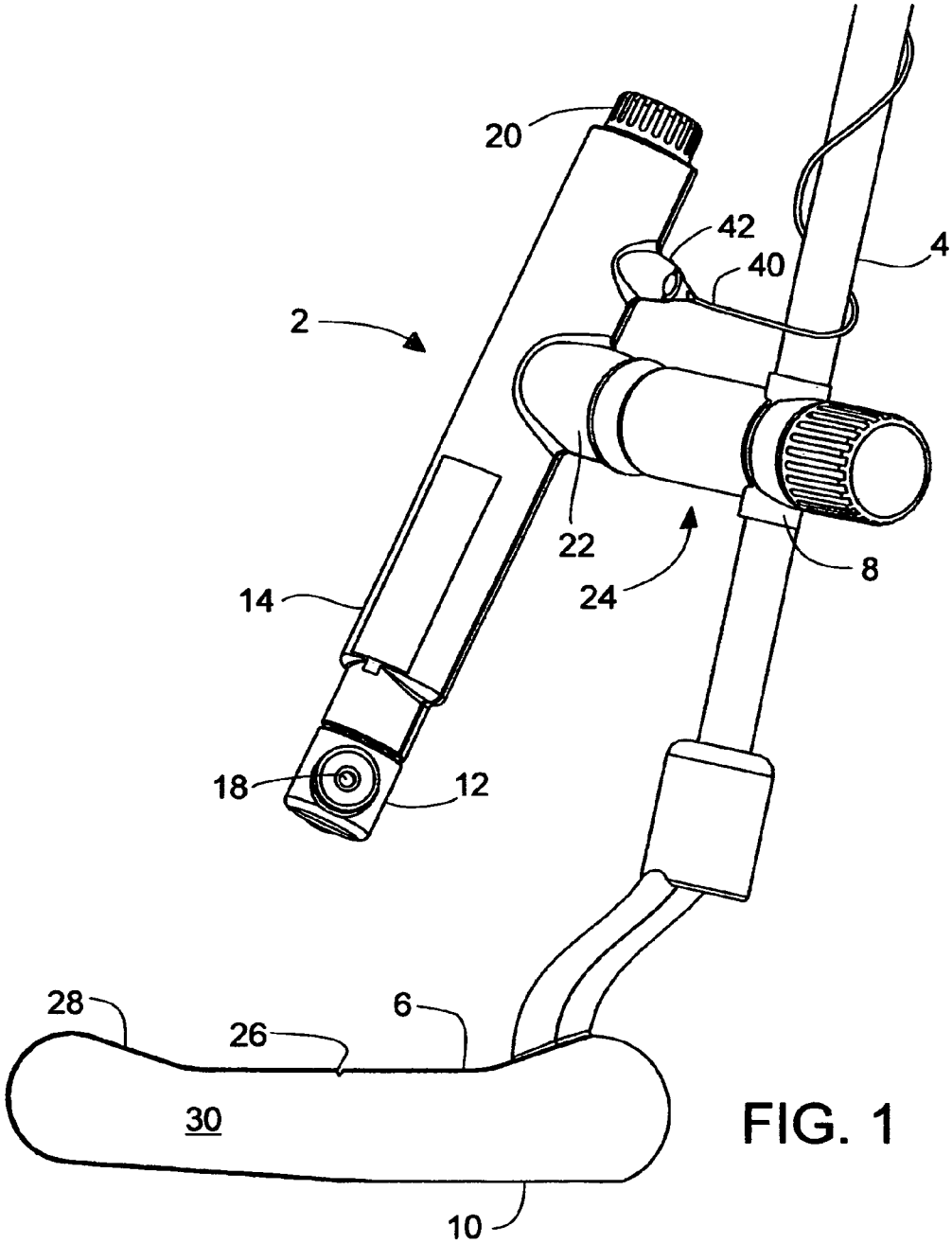
FIG. 1 is a partial elevation view of a laser emitting turret according to this invention attached to the shaft of a putter.
Figure 2:
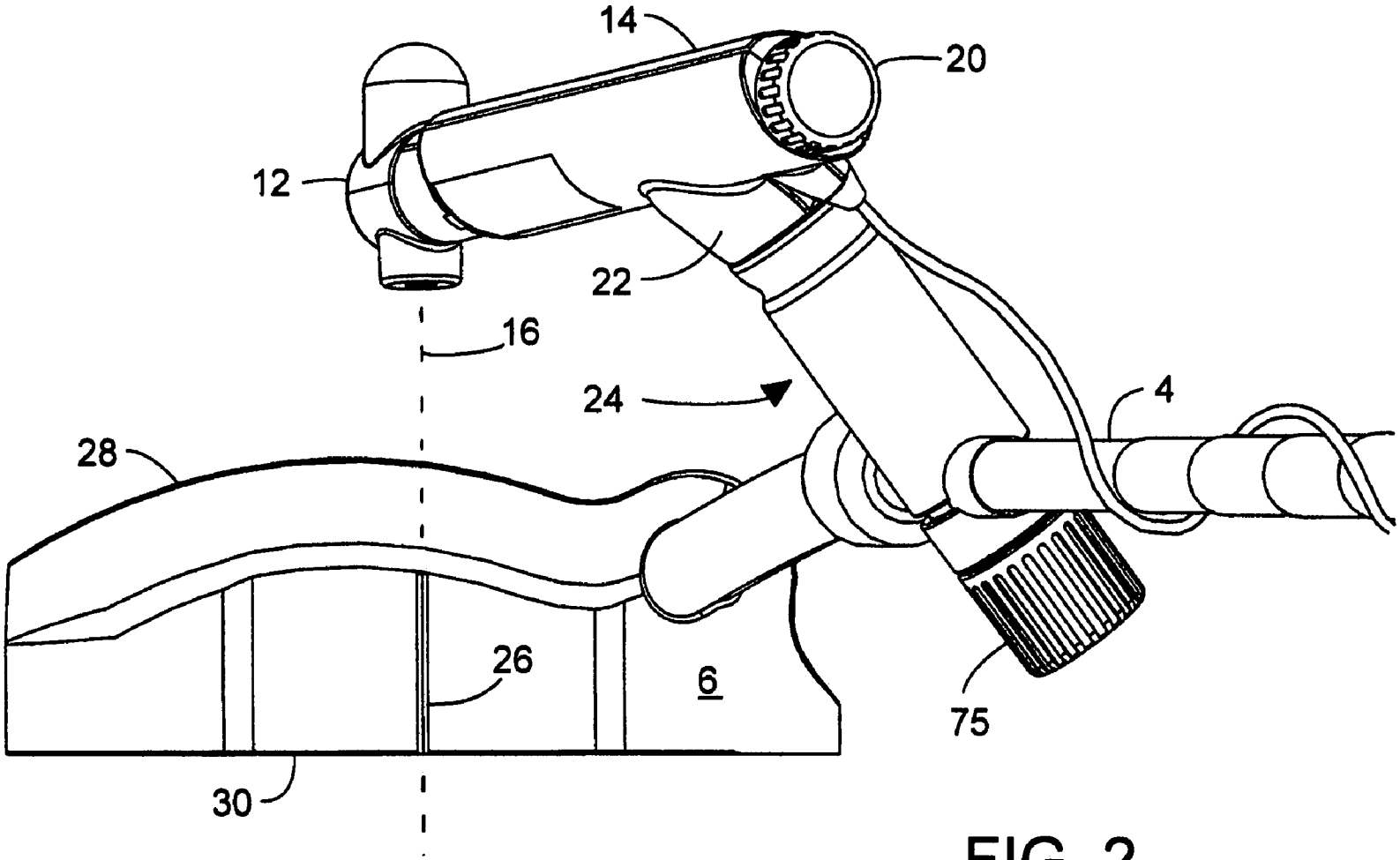
FIG. 2 is a partial plan view of the a laser emitting turret attached to the shaft of a putter.

Referring to FIGS. 1 and 2, a laser assembly portion of the putter alignment training system of this invention is generally designated 2, and is shown attached to the shaft 4 of a putter 6. Preferably a piece of friction tape 8 is affixed to the shaft of the putter approximately 5 inches above the sole 10 of the putter. The tape is preferably a small piece of removable adhesive-backed tape wrapped around the shaft 4 to prevent the attached laser assembly from slipping out of place. The tape preferably has an outer surface that has some texture or roughness and the tape is slightly compressible. The laser assembly includes a laser beam emitter (100 of FIG. 7) housed within a turret 12 which is rotatably affixed to a lower end of a tubular body 14. The turret contains batteries (not shown) used for supplying energy to operate the laser. The laser, represented by dashed line 16, is emitted through an aperture 18 of the turret and projects perpendicular to a long axis of the body 14. The turret is rotatable about the axis of the body within a range of preferably 180°. As will be described in more detail below, the turret neck has an annular collar which rotatingly slides within a concentric groove defined by the lower end of the body, and a concentric spring washer is disposed between interfacing surfaces of the turret and the body to frictionally hold the turret in selected rotated disposition with respect to the body. Threadably affixed to the upper end of the body 14 is a battery chamber cap 20 for securing the batteries (not shown) in the body. The cap has a spring contact and a washer (not shown) serving to apply pressure to the batteries and also to make electrical contact with the negative end of one of the batteries.

Figure 6:
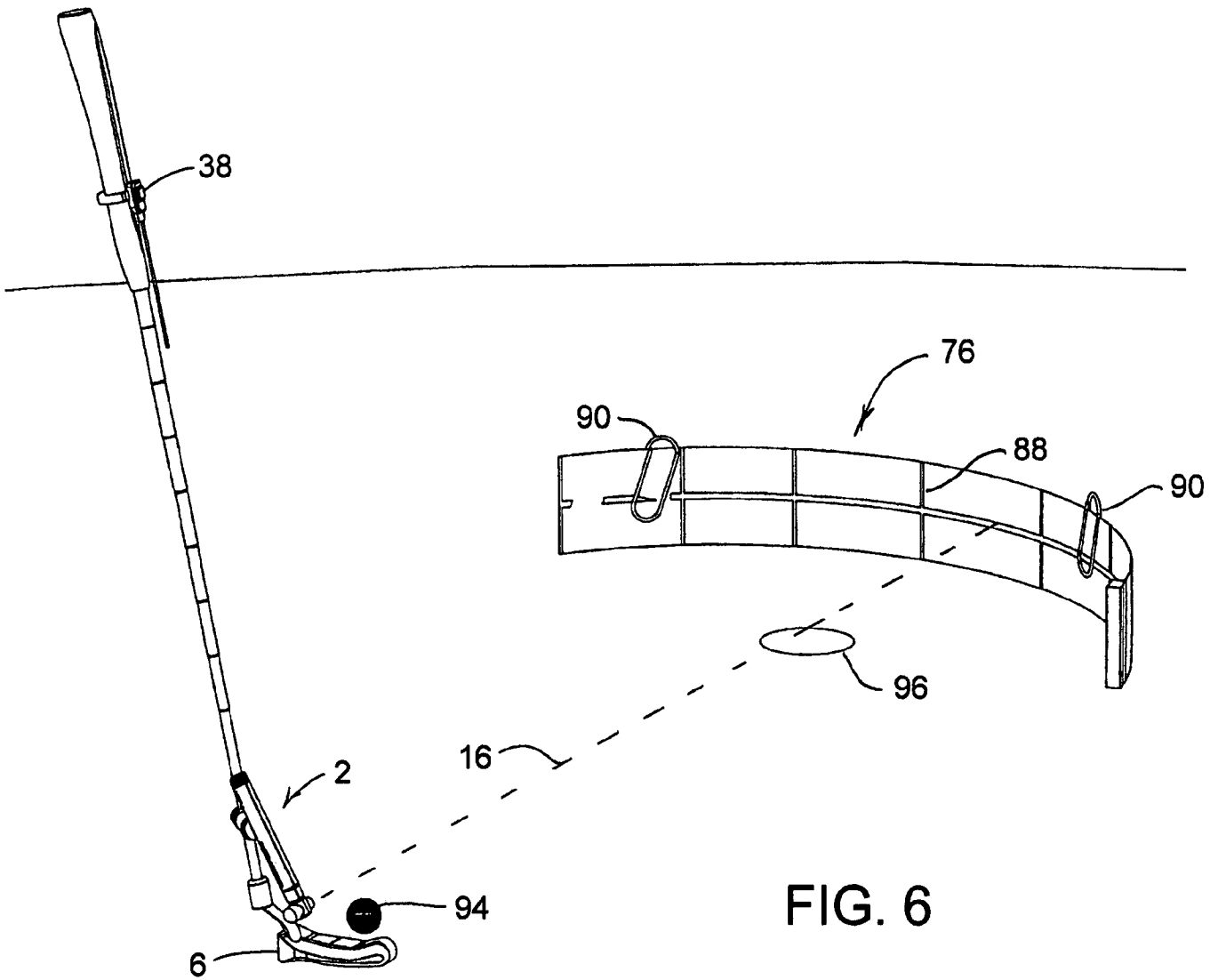
FIG. 6 is a pictorial view of the invention being used by a user to practice alignment of his or her putter with a target hole.

Referring again to FIGS. 1 and 2, a hollow stub 22 extends normally from the body 14 intermediate the turret and the battery chamber cap. A clamp, generally designated 24, described in more detail below, is articulated with the stub. As illustrated, the clamp is gripping the shaft 4 over the friction tape 8 and supporting the body 14 while holding it in place. When the clamp is loosened, the body can be rotated about the putter shaft, and the articulation allows the body to be pivoted and rotated within a conal range, i.e., within a volume of space defined by a cone, preferably 60°, normal to the body. This allows the turret to be moved forward and backward, and laterally with respect to the head 28 of the putter 6, and as previously mentioned, the turret is rotatable about the body. All of these degrees of movement allow a user to so dispose the turret aperture that it can be rotatably adjusted about the body to direct the laser horizontally in a plane passing through the sweet spot of the putter face and perpendicular to the face of the putter when a user is addressing a golf ball with the putter, as best illustrated in FIGS. 2 and 6. For clarity, said plane shall be referred-to as the "alignment plane." Typically a putter's "sweet spot" is marked by a line 26 imprinted on or notched into the top of the head 28 of the putter, as best illustrated in FIG. 2. The line 26 is an indication of the center of gravity or mass of the putter head. The area in line with the mark on the face 30 of the putter is referred to as the "sweet spot" and is so named because when a ball is struck at the sweet spot, its trajectory will be the most accurate because any horizontal pivoting of the head due to the impact with the ball will be minimized. When the aperture has been properly positioned, the clamp 24 can be tightened which will secure the putter alignment device 2 in its selected position.

Figure 3:
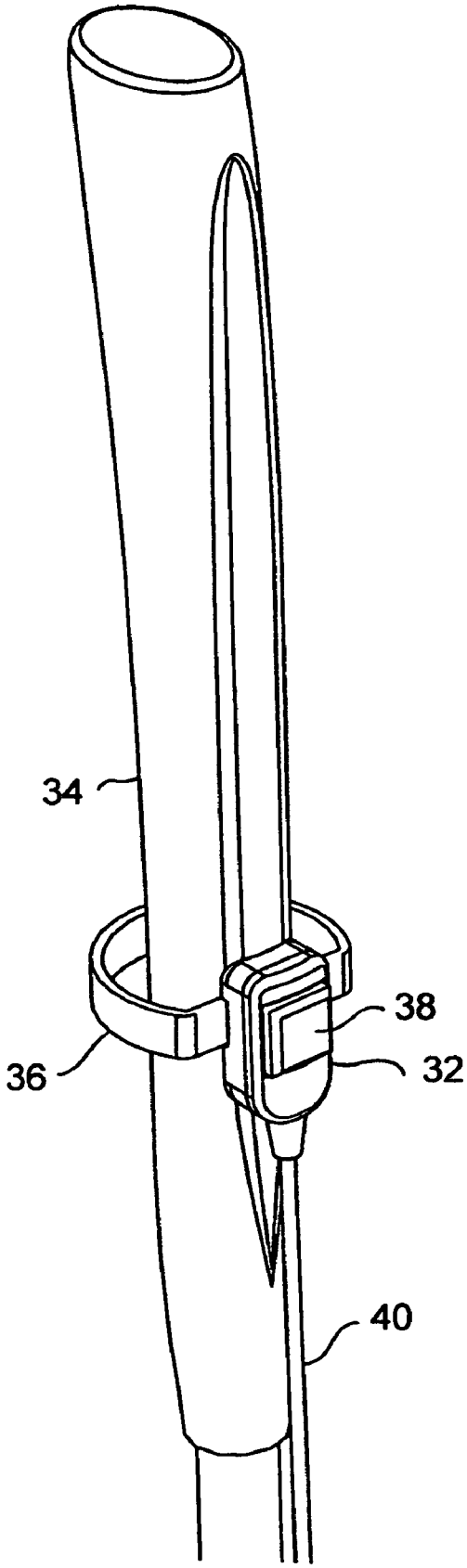
FIG. 3 is a partial pictorial view of an activation switch for the laser in position for attachment to the grip of a putter.

Referring to FIGS. 1–3, a switch 32 for actuating the laser is disposed on the grip 34 of the putter preferably proximate to where a golfer's lower thumb will be when gripping the putter for a putt. The switch can be removably affixed to the grip by means of hook and loop type straps 36 affixed to the switch. The switch has a button 38 for actuating the laser. The switch is connected to the body 14 by a pair of wires 40 molded together and running from the switch 32 to the body where the wires pass through an opening defined in a nipple 42 extending a short distance normally from the body.

Figure 4A:
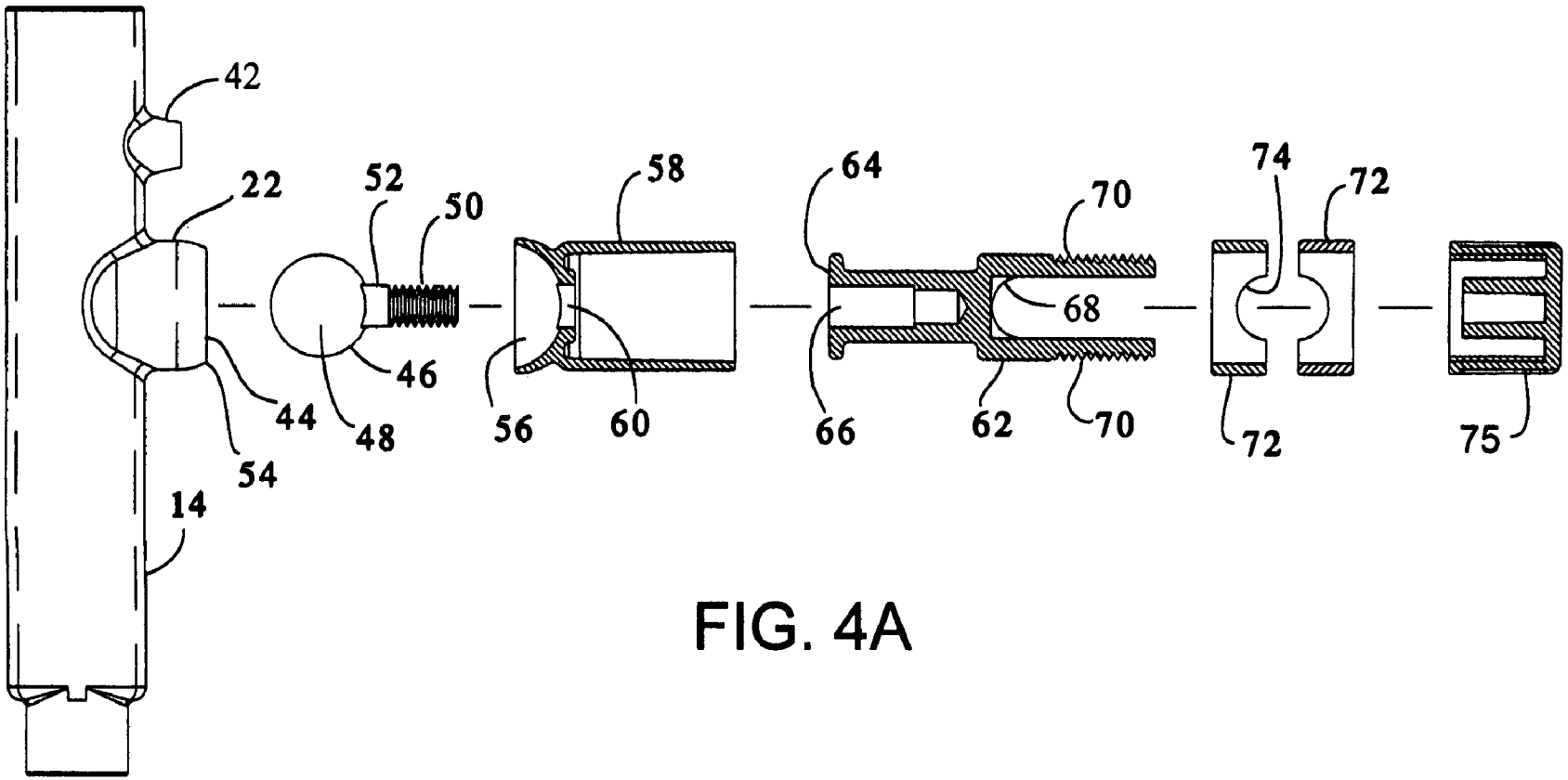
FIGS. 4A and 4B are exploded views of an articulated arm by which a body that supports the laser turret is attached to a putter shaft, FIG. 4A including pieces in cross-section for clarity.
Figure 4B:
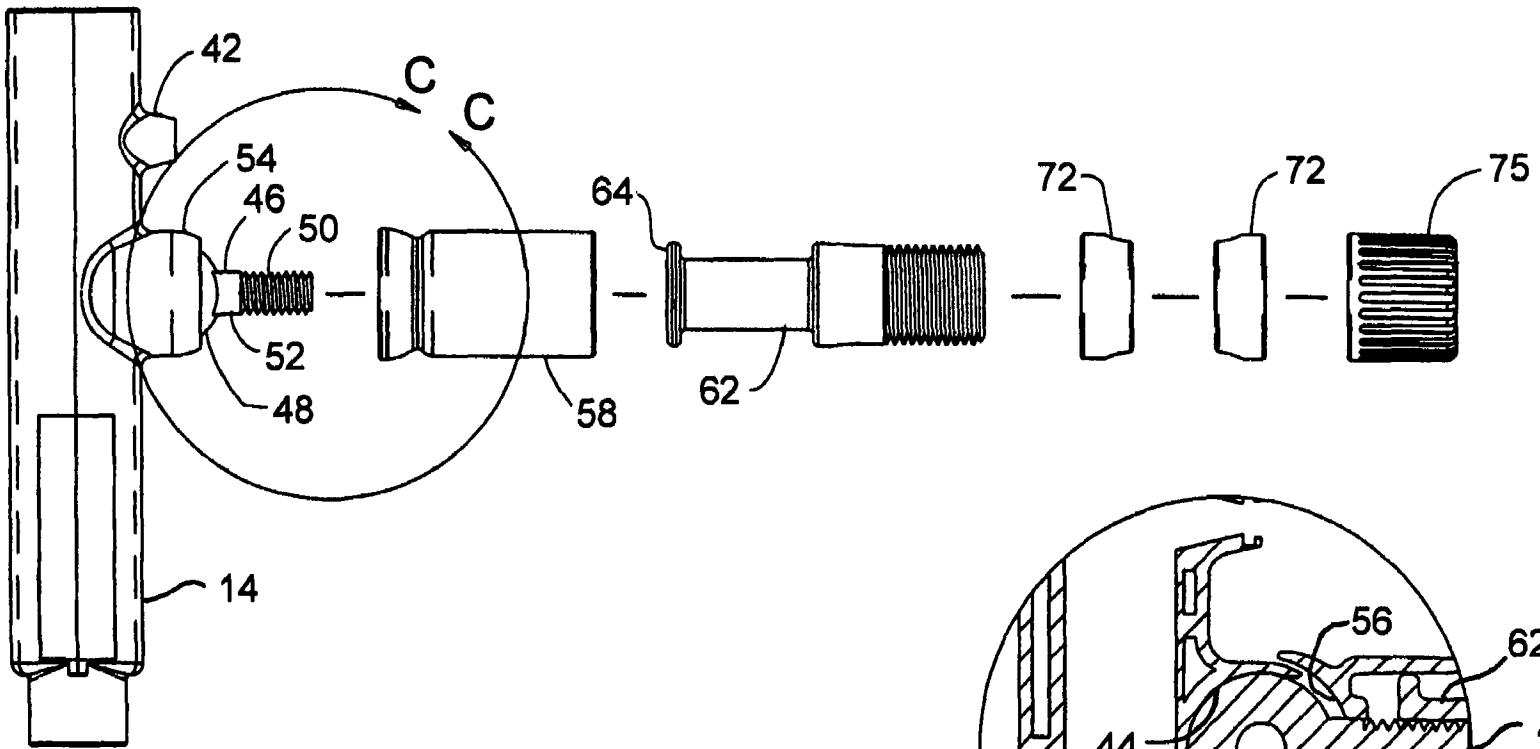
Figure 4C:
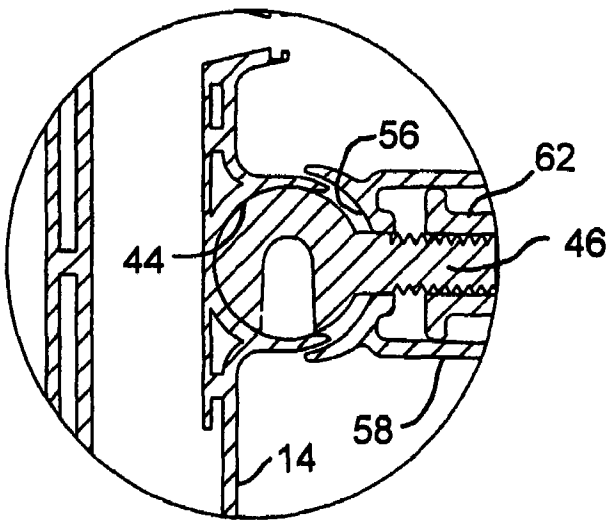
FIG. 4C is a detail cross-sectional view of the articulation of the attachment arm of FIGS. 4A and 4B illustrated here as a frictionally lockable ball joint.

Referring to FIGS. 4A–4C, the stub 22 defines a spherically shaped ball socket 44, and preferably the body 14 is made in two halves or sides, and a ball assembly 46 is placed in the socket as the two sides of the body are joined such that the ball 48 is thereafter disposed in the ball socket. The end of the stub defines a circular mouth having a diameter large enough to allow a section of the ball to protrude beyond the end of the socket mouth, but smaller than the diameter of the ball, preventing the ball from being pulled out of the socket. A stem 50 extends radially from the ball 48. The stem is threaded except for its generally cubic shaped base 52. The outside surface of the end of the stub 54 is rounded, to conform to a partial spherically shaped cup 56, defined by an end of a barrel 58, which is assembled over the rounded end 54 of the stub. The barrel is cylindrical and open at the other end. The spherical cup 56 defines a concentric channel 60 having a square cross section which communicates with the hollow center of the barrel. When the barrel 58 is assembled over the rounded end of the stub 54, the threaded stem 50 of the ball joint protrudes through the channel 60 into the cylindrical section of the barrel and the cubic shaped base fits into the square shaped channel 60. A linking rod 62 shaped generally like a tuning fork has a shank section with a flat end 64 which defines a threaded axial hole 66. The remainder of the rod defines a "U" shaped slot 68 for accommodating a putter shaft which in operation is straddled by the two prongs 70 of the rod. The two prongs 70 are externally threaded. The rod 62 is assembled by inserting its shank end into the barrel where it can freely travel back and forth. The stem 50 of the ball assembly 46 is screwed into the threaded hole 66 defined in the link rod shank. Two cylindrical spacers 72 each with opposing circular notches 74 freely slide over the slotted end of the rod for clamping a putter's shaft therebetween. One of the spacers 72 abuts the barrel 58. To complete the clamp assembly 24 (FIGS. 1 & 2) a second collar 72 is assembled over the rod's prongs with its notches 74 facing the notches of the first collar. A threaded knob 75 is then threaded onto the threaded prongs 70. In operation, the tightening of the knob over the threaded end of the rod acting against the two spacers and the barrel and also causing tension through the rod to the ball stem, the spacers in reaction to the force of the knob clamping the putter shaft, and the barrel in reaction to the force of the knob transmitted through the spacers applying compression force to the mouth of the ball socket via the barrel's spherical cup.

Referring to FIGS. 1 and 4, the laser assembly portion 2 of this system can be affixed to the shaft 4 of a putter 6 by the clamp 24. The clamp is assembled as described above, except the second spacer 72 and knob 75 are removed, allowing the putter's shaft, covered by the friction tape 8 to be inserted between the threaded prongs 70. The second spacer 72 with the notches 74 facing the shaft is then fitted over the prongs. The two spacers should be positioned so the shaft, which is disposed in the U-shaped slot 68, is enclosed by the notches 74 in the spacers 72. The knob 75 can then be threaded over the prongs 70. When the knob is tightened, the dimensions of the clamp parts are such that the clamp will hold the body 14 rigidly in position, preventing it from rotating or pivoting. Tightening the knob pulls the link rod 62, which in turn pulls the ball 48 since the threaded stem 50 is threaded into the rod. The knob 75 abuts the second spacer 72 which fits against the putter's shaft 4 and the first spacer 72 abuts the barrel 58 and the shaft 4. In this arrangement, before the knob is fully tightened, there is no tension to pull the ball 48 against the mouth of the ball socket 44. This allows the body 14 to move as described above. When the knob 75 is tightened, it pushes the second spacer 72, which pushes the shaft 4, which pushes the first spacer 72, which pushes the barrel 58 which applies its spherical cup 56 against the ball socket mouth preventing the mouth from being forced open by internal pressure from the ball 48 being pulled by the rod. The tensions and forces described above create and increase friction within the ball joint while at the same time forcibly clamping the putter shaft between the two spacers 72. In this manner the articulation can be locked to keep the body 14 in selected place. After locking the body in place, the turret can then be rotated to properly orient the laser aperture.

Figure 5:
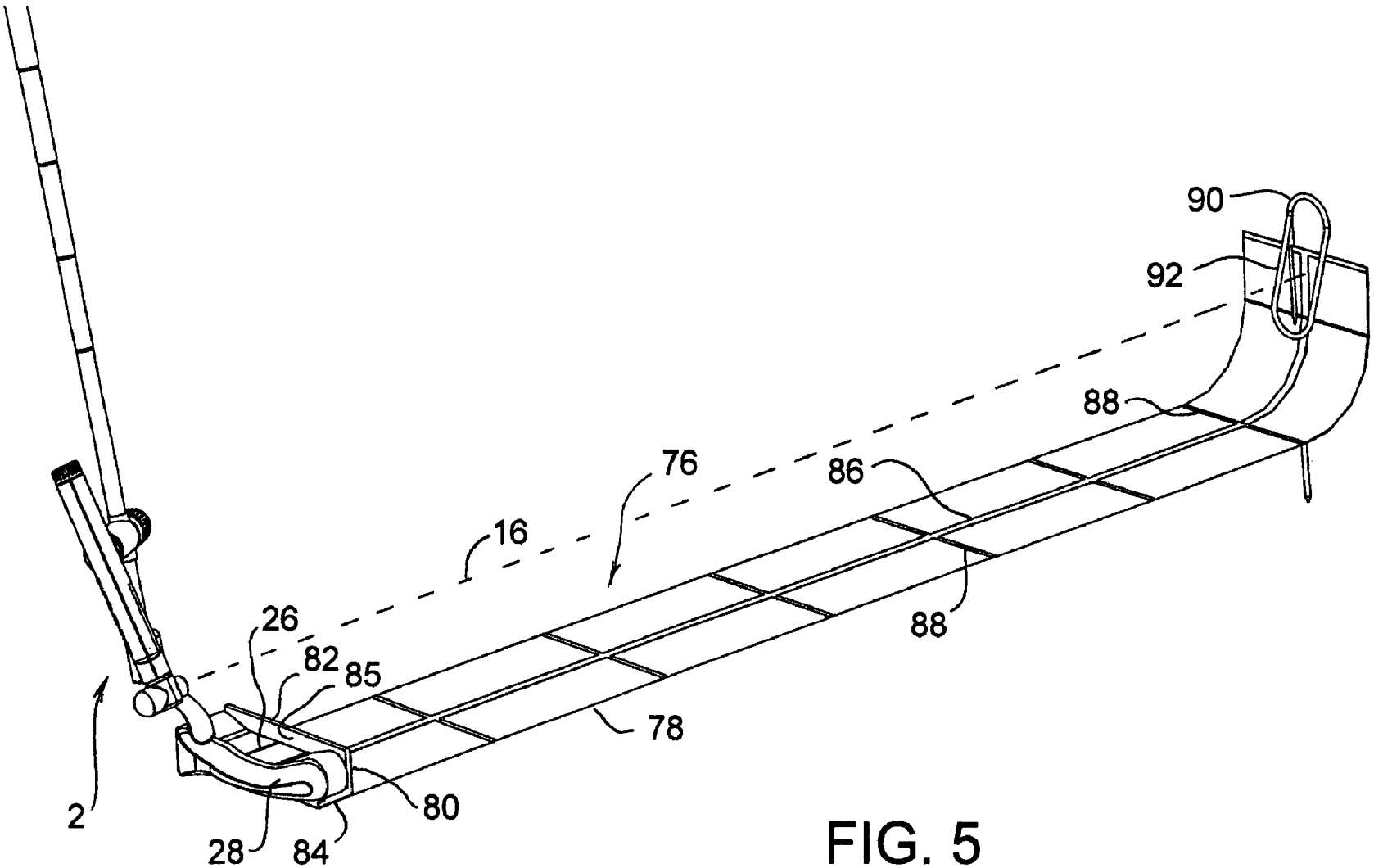
FIG. 5 is a pictorial view of a method and means, according to this invention, by which an attached laser turret is aligned with the "sweet spot" of the putter to which it is attached.

Referring to FIG. 5, to align the laser properly within the alignment plane, as defined above, an alignment guide, generally designated 76, can be used. As illustrated, the alignment guide is a flat, elongated flexible strip 78, preferably plastic and preferably approximately four inches wide by thirty-six inches long, which in use is rolled out flat onto a flat surface. At one end of the guide the strip is adhesively affixed to an alignment cradle 80 which is disposed perpendicular to a marked stripe 86 on the strip. Preferably the alignment cradle comprises two rigid, angled walls, preferably aluminum, having a generally "L" shaped cross-section, i.e., having one upright (in use) wall 82 for abutting the face of a putter, and the other wall 84 adhesively affixed to the strip 78 upon which the putter is placed to anchor that end of the strip, as best illustrated in FIG. 5. The abutting wall 82 is perpendicular to a straight line 86, preferably a centerline, running the length of the strip. Preferably the angle between the abutting wall 82 (the upright leg) and the other wall is preferably 86° because putters generally have a 4° loft, with the face 30 of the putter 6 angled back toward the rear of the putter four degrees from a vertical plane. With and angle of 86°, the alignment cradle 80 can squarely abut the putter face for more precise alignment. When the putter 6 is placed in the cradle 80 as described above (resting on the wall 84 and the face 30 of the putter abutting the wall 82) and the putter's sweet spot mark is aligned with the strip's line 86, the putter will be aligned with the line 86. Preferably the line 86 is blue to help the spot illuminated by the laser, the laser spot, to be easily visible. The strip is also marked with a plurality of lateral lines 88 running across the strip, perpendicular to the longitudinal line 86 and preferably at five inch intervals.

Referring to FIGS. 3–5, the alignment guide 76 should be unrolled onto a flat surface with its distal end raised high enough to intercept the laser beam. If indoors, the end of the strip 78 distal from the alignment cradle can be held up by a vertical structure, such as a wall. If outdoors, the end of the guide can be propped up by an object or it can be held upright by a ground stake 90 clipped onto the end of the strip 78. The ground stake is preferably a stainless steel rod coiled at one end to form an overlapping oval coil 92. The straight end of the rod can be pushed into the soil to secure the ground stake. The end of the strip can be held upright by the coil in the rod with the strip held between the straight leg and the overlapping oval. To align the putter 6, the laser assembly 2 is attached to the shaft 4 of the putter as described above. The head 28 of the putter is placed onto the alignment cradle 80 as described above, and the "sweet spot" mark 26 on the head of the putter is aligned with the line 86. The laser turret's position and orientation is then adjusted, as described above until the laser beam is properly intercepted by the distal end of the strip as best shown in FIG. 5. When the laser beam illuminates a spot on the distal end of line 86, the laser is properly aligned with the putter for the purposes of this invention.

Referring to FIG. 6, with the putter 6 aligned, the laser can be used to check the golfer's visual alignment of the putter with a golf ball 94 and a target such as a golf hole 96. If indoors, the leg of a table or the corner of a wall can be used as targets. If outdoors the alignment guide 76, placed upright on its side and held in place by at least one ground stake 90, can used as a reflective backdrop behind a target so the spot illuminated by the laser beam can be seen. When the golfer has visually aligned the putter he can check his alignment by pushing the activation button 38 to produce a laser beam 16. The spot illuminated by the laser beam will indicate the true alignment of the putter. The difference between the golfer's alignment, if any, and the spot illuminated by the laser beam is the error due to the golfer's misalignment. It can be surprising how far off the golfer's alignment may be. Several inches is not uncommon. The cross stripes 88 aid in determining the extent of any error. Repeatedly using the laser beam to check on visual alignments will serve to train the golfer to more accurately align his putter. The laser is only used intermittently to check or verify the golfer's visual alignment.

Figures 7, 8, 9:
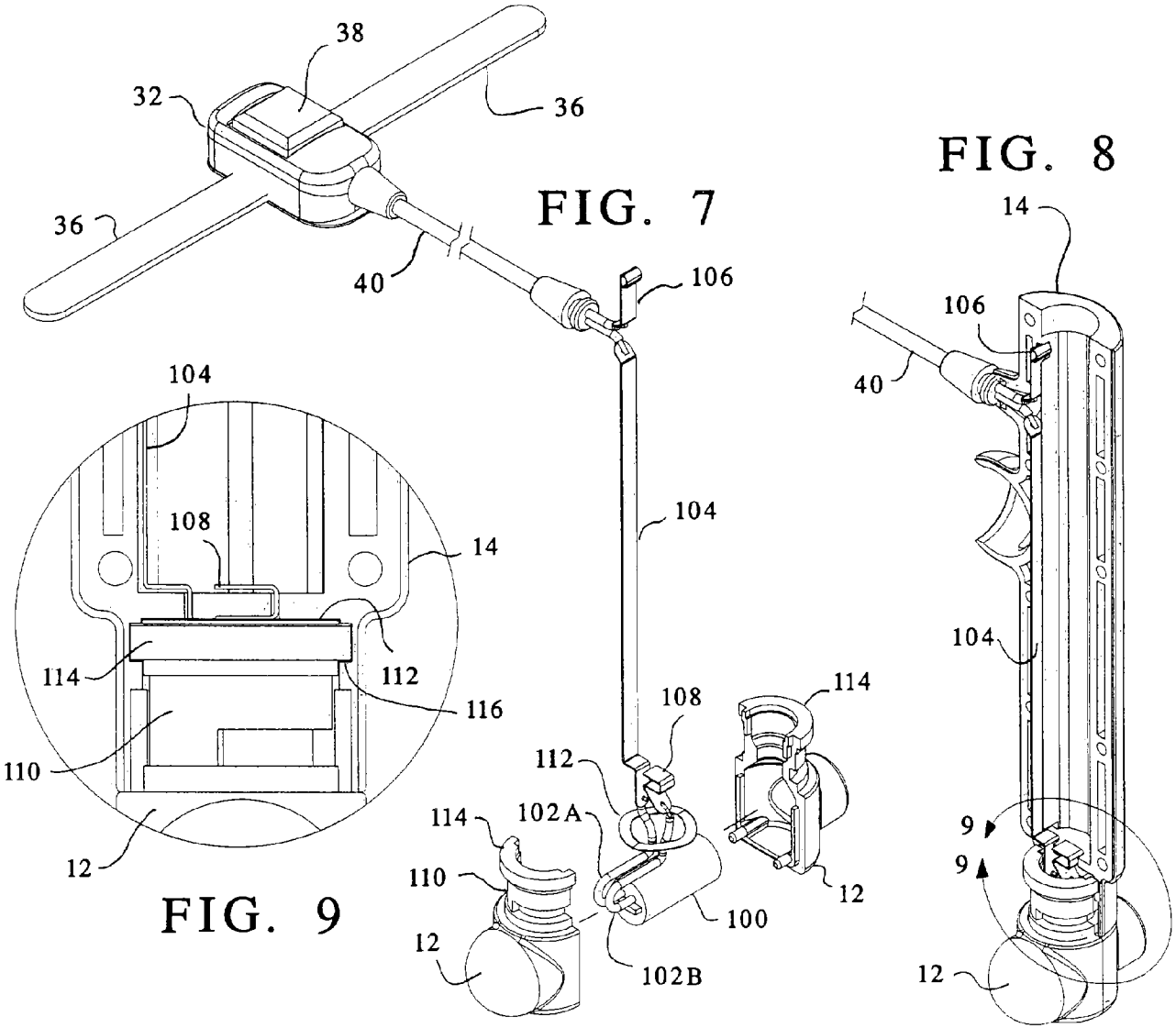
FIG. 7 is an exploded pictorial view of the laser turret and its electrical connection to a battery chamber of the body and the remote activation switch.
FIG. 8 is a pictorial view showing the parts of FIG. 7 assembled.
FIG. 9 is an enlarged view of section 9—9 of FIG. 8.

Referring to FIGS. 7 and 8, the laser 100 is shown connected to the switch 32 by lead wires 102A and 102B, with lead wire 102A connected to the lower negative contact 104, which is connected to one of the lead wires 40 from the switch and the second of the lead wires 40 is connected to the upper negative contact 106. The lead wire 102B is connected to the positive contact 108. The remainder of the circuit connecting the laser with the switch is through a spring contact (not shown) in the battery cap 20 (FIG. 1) which makes contact with the negative end of one of preferably two AAA size batteries, stacked in series (plus to minus) inside the body 14 and also makes contact with the upper negative contact 106. The arrangement and connection of the batteries and battery circuit is well known and the battery cap and batteries have been omitted for clarity.

Referring to FIGS. 7–9, the laser 100 is snugly enclosed in the turret 12, generally perpendicular to the axis of the body 14 and so the laser beam generated by the laser can exit the turret through the aperture 18 (FIG. 1). The turret has a generally cylindrical collar 110 which fits into the lower end of the body 14 after its two halves have been assembled together over the laser. However, prior to the laser lead wires 102A and B being connected to the switch battery circuit, the wires are inserted through a spring, i.e., wave washer 112. The washer is oval shaped and has a plurality of slight resilient bends in it, giving it a generally wavy appearance. The turret collar 110 terminates in a generally annular lip 114 which fits into a circular groove 116 defined by the inside of the body 14. Before the lip is inserted into the groove, the wave washer 112 is placed on the top surface of the lip and can be forced into the groove with the lip 114 of the turret's collar 110. When the two halves of the body 14 are assembled over the turret's collar, the now compressed lip pushes against the lip, taking up any slack between the turret and the body and allowing the turret to be able to maintain whatever rotational position in which it is placed. Because of the tension clamp 24 which can secure the body 14 in a selected position and the wave washer 112 which enables the turret to maintain a selected position, once the putter alignment device 2 is aligned, it will maintain its alignment even after being used to putt golf balls.

Preferably the body and the clamp parts are plastic, though they could be made from any common rigid material. The parts can be die cast, allowing them to be lightweight and have uniform dimensions which can be carefully controlled.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. A putter alignment training system comprising:

(a) a turret including a laser emitting aperture;

(b) a remote switch for actuating the laser;

(c) a body having an axis, the turret being rotatably affixed to the body;

(d) a lockable, ball joint articulated support arm projecting radially from the body; and (e) a clamp for attaching the arm to a putter shaft; and (f) the articulated arm being adjustable to so dispose the turret aperture that it can be rotatably adjusted to direct the laser horizontally in a plane passing through the putter's sweet spot and perpendicular to the face of the putter when a user is addressing a golf ball with the putter.

2. The system of claim 1 wherein a backdrop is disposed behind a target to be impinged by the laser beam for visual indication of the alignment of the putter.

3. The system of claim 2 wherein the backdrop includes calibrations for gauging the degree of misalignment of the putter from the target.

4. The system of claim 2 further comprising an alignment guide comprising:

(a) an elongated strip for lying flat on a horizontal surface;

(b) a straight line running the length of the strip;

(c) a cradle affixed at one end of the strip for abutting engagement with the putter face so that the straight line on the strip is perpendicularly aligned with the sweet spot of the putter; and (d) a support for holding the distal end of the strip upright, the laser impinging the straight line on the upright end of the strip when the aperture is properly aligned.

5. The system of claim 4 wherein the support comprises a ground stake with clip means for holding the distal end of the strip.

6. The system of claim 4 wherein the alignment guide is disposed behind a target to be painted by the laser beam for visual indication of the alignment of the putter.

7. The system of claim 4 the alignment guide includes calibrations for gauging the degree of misalignment of the putter from the target.

8. The system of claim 1 further comprising:

(a) a ball enveloped by a ball socket sufficiently to confine the ball to the socket, the ball having a radial threaded stem projecting from a mouth of the socket;

(b) a cylindrical barrel with a spherical cup at one end having an axially centered hole through which projects the threaded stem;

(c) one end of a rod is disposed in the barrel and freely travels back and forth therein, said one end defines an axial hole, the other end of the rod is threaded externally and defines an open slot to accommodate a putter's shaft, the threaded stem being screwed into the axial hole;

(d) two hollow cylindrical spacers, each defining opposing circular notches, freely slide over the slotted end of the rod for clamping a putter's shaft in the notches; and (e) a threaded knob engaged with the slotted end of the rod, the tightening of the knob over the threaded end of the rod acting against the two spacers and the barrel and also causing tension through the rod to the ball stem, the spacers in reaction to the force of the knob clamping the putter shaft, and the barrel in reaction to the force of the knob transmitted through the spacers applying compression force around the mouth of the ball socket via the barrel's spherical cup.

9. A putter alignment training system comprising:

(a) a turret including a laser emitting aperture;

(b) a remote switch for actuating the laser;

(c) a body having an axis, the turret being axially rotatably affixed to the body;

(d) an articulated support arm projecting radially from the body, the articulated arm being adjustable to so dispose the turret aperture that it can be rotatably adjusted to direct the laser horizontally in a plane passing through the sweet spot and perpendicular to the face of the putter when a user is addressing a golf ball with the putter; and (e) a mechanism controlled by a single knob for both locking the articulated support arm when the turret is at a selected disposition and orientation, and locking the support arm to a putter's shaft.

10. The system of claim 9 wherein said mechanism comprises:

(a) a ball enveloped by a ball socket sufficiently to confine the ball to the socket, the ball having a radial threaded stem projecting from a mouth of the socket;

(b) a cylindrical barrel with a spherical cup at one end having an axially centered hole through which projects the threaded stem;

(c) one end of a rod is disposed in the barrel and freely travels back and forth therein, said one end defines an axial hole, the other end of the rod is threaded externally and defines an open slot to accommodate a putter's shaft, the threaded stems being screwed into the axial hole;

(d) two hollow cylindrical spacers, each defining opposing circular notches, freely slide over the slotted end of the rod for clamping a putter's shaft in the notches; and (e) a threaded knob engaged with the slotted end of the rod, the tightening of the knob over the threaded end of the rod acting against the two spacers and the barrel and also causing tension through the rod to the ball stem, the spacers in reaction to the force of the knob clamping the putter shaft, and the barrel in reaction to the force of the knob transmitted through the spacers applying compression force around the mouth of the ball socket via the barrel's spherical cup.

11. The system of claim 9 further comprising an alignment guide comprising:

(a) an elongated strip for lying flat on a horizontal surface;

(b) a straight line running the length of the strip;

(c) a cradle affixed at one end of the strip for abutting engagement with the putter face so that the straight line on the strip is perpendicularly aligned with the sweet spot of the putter; and (d) a support for holding the distal end of the strip upright, the laser impinging the straight line on the upright end of the strip when the aperture is properly aligned.

12. The system of claim 9 wherein a backdrop is disposed behind a target to be impinged by the laser beam for visual indication of the alignment of the putter.

13. The system of claim 12 wherein the backdrop includes calibrations for gauging the degree of misalignment of the putter from the target.

14. An apparatus for mounting an adjustably aimed laser emitter onto a golf shaft comprising:

(a) a support member extending laterally from the shaft, said member being pivotable about the shaft whenever the support is not locked in place relative to the shaft;

(b) a turret including a laser emitter;

(c) a body, the turret being affixed to the body;

(d) an articulation affixing the body to the support member, the articulation when not locked allowing the body to be pivoted universally relative to the support member;

(e) a remote switch for actuating the laser emitter;

(f) a clamping mechanism that when tightened locks the support member and the articulation in place.

15. The apparatus according to claim 14 wherein the body has an axis and the turret is rotatable about the axis whether or not the articulation is locked in place.

16. The apparatus according to claim 14 wherein the articulation comprises a ball joint.

17. The apparatus according to claim 16 wherein the clamping mechanism when tightened applies a force frictionally pinning the ball to a mouth of a ball socket to lock the articulation in place.

18. The apparatus according to claim 17 further comprises:

(a) a clamp for locking onto the club shaft;

(b) a threaded stem extending axially from the ball through an open mouth of the ball socket;

(c) a control knob for being rotated by a user's fingers; and (d) an assembly including a hemispherical cup at one end that envelopes the open mouth of the ball socket to constrain it from expanding, and a threaded stud at the opposite end that threadingly engages the knob, the clamp being disposed between the knob and the assembly;

(e) the tightening of the control knob forcing the clamp in reaction to correspondingly tighten against the club shaft, and simultaneously pulling on the ball stem forcing it against the ball socket mouth that is constrained from expanding by the assembly's hemispherical cup.

19. The apparatus according to claim 14 wherein the clamping mechanism further comprises a single control for operatively tightening and loosening of the mechanism.

* * * * *